United States Patent [19]

Schneider

[11] 4,407,024

[45] Oct. 4, 1983

[54] TOILET SEAT LID COVER

[76] Inventor: Helga Schneider, 3865 Spanish Oaks Dr., West Bloomfield, Mich. 48033

[21] Appl. No.: 333,673

[22] Filed: Dec. 23, 1981

[51] Int. Cl.[3] ..... A47K 13/14

[52] U.S. Cl. ..... 4/242; 4/234

[58] Field of Search ..... 4/234, 242, 661, DIG. 9, 4/243

[56] References Cited

U.S. PATENT DOCUMENTS

| | | | |
|---|---|---|---|
| 1,036,217 | 8/1912 | Girouard | 4/242 |
| 2,167,587 | 7/1939 | Rowe | 4/242 |
| 2,994,887 | 8/1961 | Thornton | 4/242 |
| 3,653,076 | 4/1972 | Warnberg | 4/242 X |
| 3,905,051 | 9/1975 | Gozdziewski | 4/661 |

*Primary Examiner*—Charles E. Phillips

*Attorney, Agent, or Firm*—Barnes, Kisselle, Raisch, Choate, Whittemore & Hulbert

[57] ABSTRACT

A cover for a toilet seat and lid comprising a pocket adapted to be releasably secured over a typical ovate lid and having a face-like contour on one side. A pair of arms integrally and flexibly extend from an open edge of the pocket beneath the face-like contour, and are of a length and configuration to overlie the toilet seat with the free-ends of the arms partially overlapped. The arms terminate in hands having opposed hook-and-loop fastener patches for securing the hands to each other when not in use.

6 Claims, 5 Drawing Figures

TOILET SEAT LID COVER

The present invention is directed to toilet seat lids and lid covers, and more particularly to a one-piece cover for toilet seat lids which is specifically adapted for use by infants and preschool children.

An object of the present invention is to provide structure for a toilet seat and lid which is adapted for use by infants and preschool children to give a sense of security to a child seated on the toilet seat.

A further object of the invention is to provide a structure of the described type which possesses an ornamental appearance which is both pleasing to the child, and thereby enhances the aforementioned sense of security, and to others who may use the facilities.

Another object of the invention is to provide the described structure in the form of a one-piece cover assembly adapted for use with existing toilets of conventional size and configuration.

The invention, together with additional objects, features and advantages thereof, will be best understood from the following description, the appended claims and the accompanying drawings in which:

FIG. 5 is a view similar to FIG. 4 showing a modification of the invention.

Figure 1:
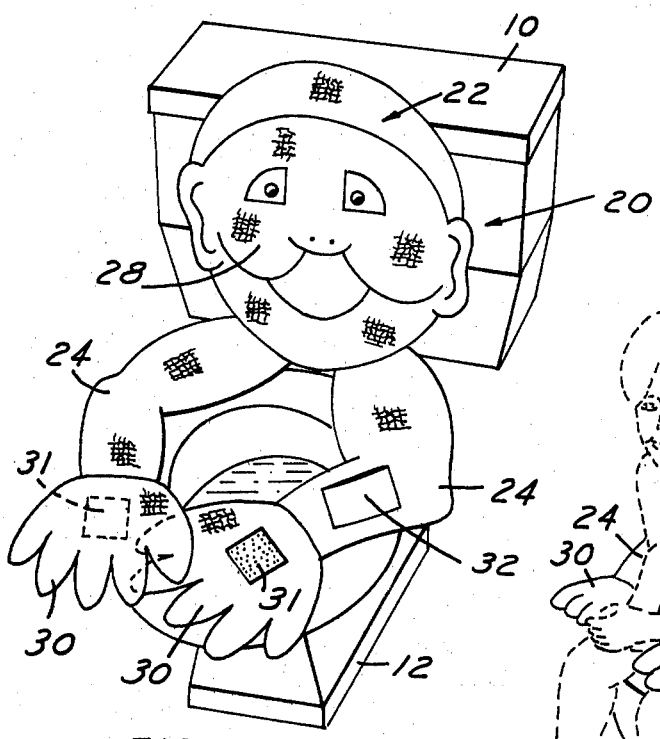
FIG. 1 is a perspective view of a presently preferred embodiment of the toilet seat lid cover in accordance with the invention installed on a typical domestic toilet unit.
Figure 2:
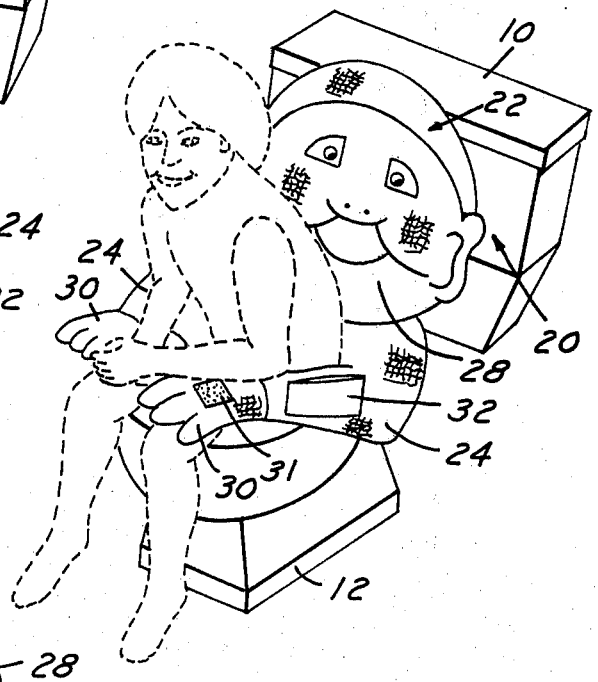
FIG. 2 is a perspective view of the embodiment of FIG. 1 in use.
Figure 3:
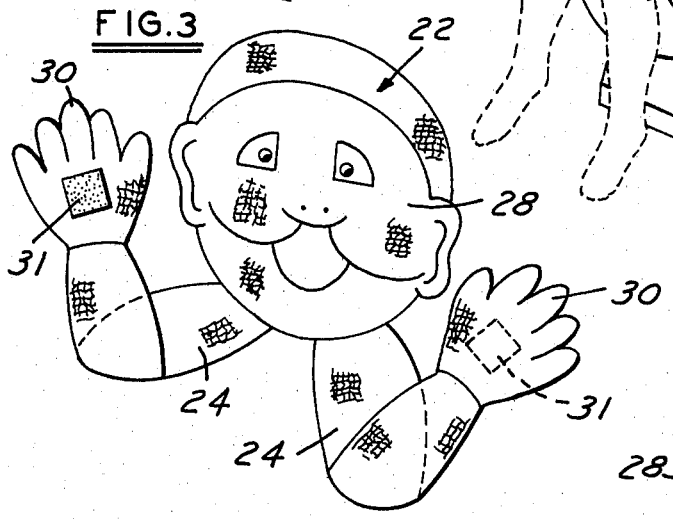
FIG. 3 is a perspective view of the one-piece cover assembly of FIG. 1 apart from the toilet.
Figure 4:
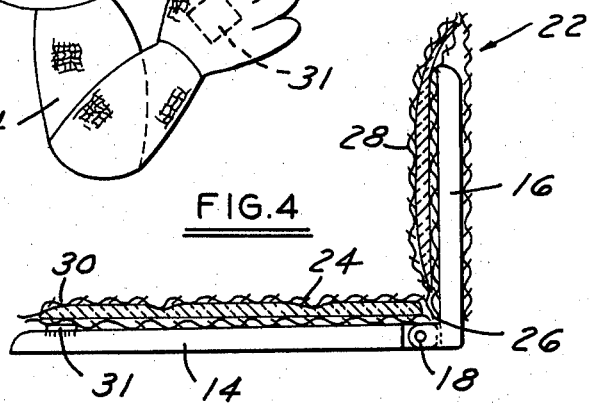
FIG. 4 is a fragmentary sectional view of the seat, lid and cover shown in FIG. 1 taken through the lid and along one arm of the cover.

FIGS. 1 and 2 illustrate a typical conventional domestic toilet is comprising a water closet or tank 10 mounted on the back of the bowl 12. A replaceable seat and lid assembly (FIG 4) typically includes a generally ovate seat 14 covering the rim of bowl 12 and a lid 16 pivotally mounted to seat by a hinge 18. Hinge 18 is typically fastened to bowl 12 (by means not shown) adjacent tank 10 so that both lid 16 and seat 14 may pivot in the vertical direction with respect to the rim of bowl 12.

A presently preferred embodiment of a one-piece seat lid cover assembly 20 in accordance with the invention is illustrated in the drawings as comprising a generally planar ovate pocket 22 and a pair of opposed shape-retaining but flexible arms 24 secured adjacent to an open edge 26 of pocket 22. Pocket 22 has an open mouth defined by edge 26 adapted to be removably received over a conventional lid 16 and releasably secured thereto as by a drawstring or elastic (not shown). Most preferably, the front panel 28 of pocket 22 adjacent to arms 24 is contoured and/or configured as a face of suitable character pleasing to youngsters. Arms 24 are stitched or otherwise flexibly secured to pocket 22.

Arms 24 are of opposed outwardly bowed generally arcuate configuration of a length adapted to rest upon and overly the upper surface of seat 14 with the free ends of arms 24 slightly overlapped, as best seen in FIG. 1. Arms 24, which are most preferably contoured as human or animal arms, terminate in a pair of hands or paws 30. Complementary patches of hook-and-loop fastening means 31, such as that marketed under the trademark VELCRO, are mounted on opposing surfaces of overlapped hands 30 so that the arms may be releasably secured together. An open pocket 32 is secured on the forward or forearm portion of one arm 24 for storing books and the like articles which may be used to amuse and occupy the child while positioned on the toilet seat. Arms 24 and cover face 28 are preferably constructed of machine-washable thickly padded cloth fabric of suitable color combinations. Arms 24 are contoured prior to stuffing so as to retain their generally arcuate configuration in normal use.

In use, a child or parent first removes arms 24 from seat 14 and the child is then positioned on seat 14. Note that, in the case of an infant, a supplemental ring and deflector arrangement may be placed upon the seat without interference from or interfering with the cover arms. Arms 24 are then encircled or wrapped around the thighs and/or lower abdomen of the child, which gives the child an enhanced sense of security when using the facilities. If desired, the hands 30 may be secured together when wrapped around the child by the fastening means 31. The child may also hang on to the padded arms 24 to impart a feeling of additional support and stability. The envelopment by the thickly padded arms 24, particularly when combined with the familiar and friendly face-like structure of pocket 22, arms 24 and hands 30, reduces the insecure feeling of exposed vulnerability commonly encountered as an obstacle in toilet training infants and preschoolers.

In the modification shown in FIG. 5 the face 28 is made a permanent part of the lid at the time of manufacture and the arms 24 are secured to the lid and seat adjacent hinge 18.

The invention claimed is:

1. A toilet seat lid cover comprising a pocket adapted to be removably secured as a cover over a toilet seat lid and a pair of generally arcuate laterally opposed shape-retaining flexible arms extending from an open edge of said pocket, said arms being of arcuate configuration and length so as to be adapted to lie upon and substantially cover a toilet seat with said pocket removably secured over the toilet seat lid and the lid in the raised position.

2. The invention set forth in claim 1 further comprising a pocket adapted to hold books and the like articles secured to one of said arms.

3. The invention set forth in claim 1 further comprising fastener means carried at free ends of said arms for removably securing said free ends to each other when wrapped around a child seated on the toilet seat.

4. The invention set forth in claim 3 wherein said fastener means comprise opposed complementary hook-and-loop fastener patches secured to said arms.

5. The invention set forth in claim 1 wherein said pocket includes means forming a face-like image on the underside of said lid, and wherein said arms include means forming hands at the opposing free ends of said arms.

6. The invention set forth in claim 5 wherein said cover, including said pocket and said arms, are constructed of padded fabric material.

* * * * *